US006577214B1

(12) United States Patent
DeGrazia et al.

(10) Patent No.: US 6,577,214 B1
(45) Date of Patent: Jun. 10, 2003

(54) ADJUSTMENT SCREW COVER FOR MOTOR OPERATORS

(75) Inventors: Dean Basil DeGrazia, Pittsburgh, PA (US); Erik Russel Bogdon, Carnegie, PA (US); Dominic Patrick Martelli, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/140,690

(22) Filed: May 7, 2002

(51) Int. Cl.[7] ..... H01H 3/00; H01H 51/00; H01H 9/00

(52) U.S. Cl. ..... 335/68; 200/43; 200/401; 200/331

(58) Field of Search ..... 335/202, 68, 132; 200/43

(56) References Cited

U.S. PATENT DOCUMENTS 5,323,131 A * 6/1994 Castonguay ..... 335/68
5,504,290 A * 4/1996 Baginski et al. ..... 200/401
5,605,224 A * 2/1997 Seymour et al. ..... 200/401
5,693,923 A 12/1997 Gula et al.
5,695,046 A 12/1997 Turner et al.
5,700,985 A 12/1997 Fischer et al.
5,808,532 A * 9/1998 DiVincenzo et al. ..... 335/68
5,821,487 A 10/1998 Groves et al.
5,905,239 A 5/1999 Turner et al.
6,080,947 A 6/2000 Ulerich et al.
6,111,486 A 8/2000 Fischer et al.
6,239,676 B1 5/2001 Maloney et al.
6,380,829 B1 * 4/2002 Castonguay et al. ..... 335/68

* cited by examiner

*Primary Examiner*—Elvin Enad
*Assistant Examiner*—Bernard Rojas
(74) *Attorney, Agent, or Firm*—Martin J. Moran

(57) ABSTRACT

A sliding cover plate for the adjustment screws of a circuit breaker is slidably mounted on the housing of a motor operator. The sliding adjustment plate includes snap-in tabs for engaging slots within the motor operator housing, permitting the cover to be snapped in place, and then slidably moved between a position wherein the adjustment screws are covered, and a position wherein the adjustment screws are exposed. The cover may be secured in the position wherein the adjustment screws are covered. The cover includes a first portion defining apertures corresponding to two adjustment screws, and a third, detachable portion defining an aperture for a third adjustment screw, thereby permitting the cover plate to be utilized with both three-pole and four-pole circuit breakers.

13 Claims, 11 Drawing Sheets

ADJUSTMENT SCREW COVER FOR MOTOR OPERATORS

BACKGROUND OF THE INVENTION

1. Field of the Invention

The present invention is related to trip unit housings for motor operators. More specifically, the invention relates to a motor operator housing having a sliding cover for the trip sensitivity adjustment screws, thereby providing the ability to gain or lock out access to these screws when a motor operator is installed.

2. Description of the Related Art

Although various means of selectively permitting and blocking access to the controls and adjustments of a circuit breaker to which a motor operator has been attached have been proposed, a means of selectively permitting and blocking access to the sensitivity adjustment screws of a circuit breaker, which are typically covered by the trip unit cover of the motor operator, is not addressed within any references known to the present inventors.

A typical circuit breaker includes two trip mechanisms. The circuit breaker will trip electromagnetically when an overcurrent condition generates a magnetic force, and toggles the trip mechanism. Additionally, a persistent overload, not large enough to instantly trip the breaker, will cause an increase in temperature within the circuit breaker, causing a bimetallic strip within the circuit breaker to bend until it reaches a point wherein the circuit breaker is tripped. The sensitivity of both the trip mechanisms may be adjusted by adjustment screws accessible from the face of the circuit breaker.

Circuit breakers are frequently actuated remotely, by securing a motor operator over the face of the circuit breaker, so that the motor operator can actuate the trip unit. A typical motor actuator includes an electric motor, operatively connected through a system of gears to a threaded rod. A sliding actuator is threadedly connected to the threaded rod, so that rotation of the threaded rod causes the sliding actuator to reciprocate back and forth. The sliding actuator fits over the circuit breaker's operating handle, so that movement of the actuator moves the operating handle. A kill/toggle switch at each end of the sliding actuator's range of travel shuts off the current, and reverses the direction of current that will be supplied to the motor, upon being depressed by the sliding actuator. A printed circuit board will typically contain the motor operator's control circuitry. When the user transmits a signal to close the circuit breaker, the control circuitry will supply current to the motor, thereby rotating the threaded shaft to slide the sliding actuator from one end of its range of travel to the other, thereby moving the circuit breaker's operating handle, and closing the circuit breaker. Upon reaching the end of its range of travel wherein the circuit breaker is closed, the sliding actuator hits the toggle switch at that location, thereby shutting off current to the motor, and reversing the direction of current to the motor. When the user opens the circuit breaker, the control circuit will again supply current to the motor, thereby moving the sliding actuator to the opposite end of its range of travel, moving the circuit breaker's operating handle to its open position. As before, when the sliding actuator reaches the position wherein the circuit breaker is open, it strikes a kill/toggle switch, shutting off current to the motor, and reversing the direction of current flow to the motor.

U.S. Pat. No. 5,700,985, issued to K. M. Fischer et al. on Dec. 23, 1997, describes an electrical operator having an interlock latch. The latch includes a slider plate moving between a first position permitting electrical operation of the circuit breaker to which the electrical operator is connected, a second position permitting manual operation of the circuit breaker, and a third position blocking both manual and electrical operation of the circuit breaker.

U.S. Pat. No. 5,693,923, issued to L. Gula et al. on Dec. 2, 1997, describes a motor operator for electrical switches that is pivotally mounted so that it may swing between a closed position wherein the motor operator actuates the switch, and an open position wherein the switch may be manually operated.

U.S. Pat. No. 5,821,487, issued to D. H. Groves et al. on Oct. 13, 1998, describes a lock out mechanism for a circuit breaker, wherein the circuit breaker is locked in the off position when the enclosure within which the circuit breaker is contained is opened.

U.S. Pat. No. 5,905,239, issued to D. C. Turner et al. on May 18, 1999, describes a motor operator with a means for protecting the motor from burning. The carriage within the motor operator that drives the handle of the actuated device includes a releasably secured bracket, dimensioned and configured to actuate the on limit switch. Therefore, if the motor operator is used to actuate a circuit breaker that has not been reset, the bracket will remain in contact with the on limit switch when the circuit breaker trip switch and carriage return to the off position. The motor is thereby protected from burnout during repeated unsuccessful attempts to turn on the circuit breaker. A similar motor operator is described in U.S. Pat. No. 5,695,046, issued to D. C. Turner et al. on Dec. 9, 1997.

U.S. Pat. No. 6,239,676, issued to J. G. Maloney et al. on May 29, 2001, describes a two-pole circuit breaker providing access to the calibration slots when the circuit breaker is assembled.

U.S. Pat. No. 6,111,486 issued to K. M. Fischer et al. on Aug. 29, 2000, describes a lockout assembly for trip unit settings. The lockout assembly includes a slidably mounted plate having apertures for accessing the trip unit adjustments. The plate slides between one position wherein the adjustments are accessible through the apertures, and a second position wherein access to the adjustments is blocked. When access to the adjustments is blocked, a wire clip may be inserted through an aperture in the sliding plate, and a corresponding aperture in the sliding plate's cover, thereby securing the sliding plate in this position.

U.S. Pat. No. 6,080,947, issued to P. L. Ulerich et al. on Jun. 27, 2000, describes an electrical switching apparatus, such as a circuit breaker, having a self-supporting operating mechanism module, and operating condition indicators mounted in its faceplate.

SUMMARY OF THE INVENTION

The present invention provides a sliding cover for the adjustment screws of a circuit breaker. The sliding cover may be used with either three-pole or four-pole circuit breakers, and may also include means for locking out access to the adjustment screws.

A typical three-pole circuit breaker includes two adjustment screws: one to adjust the sensitivity of electromagnetic tripping, and the other to adjust the sensitivity of thermal tripping. When a motor operator is mounted over the operating handle of a circuit breaker, to permit remote opening and closing of the breaker, the motor operator housing will typically cover these adjustment screws. It is therefore desirable to include apertures within the housing of the motor operator cover to permit access to these adjustment screws, and to provide a cover for selectively permitting and resisting access to the adjustment screws.

An adjustment screw cover of the present invention includes a plurality of snap-in tabs dimensioned and configured to mate with corresponding slots within the motor operator housing. The cover may therefore be installed on the housing by simply snapping it into place. Once installed, the snap-in tabs are slidably movable within the slots, thereby permitting sliding movement of the cover between an open position and a closed position.

When the cover is in the open position, apertures defined within the cover are aligned with the apertures defined within the motor operator housing, thereby permitting access to the adjustment screws through these apertures. When the cover is in the closed position, the apertures of the cover are not aligned with the apertures defined within the motor operator housing, thereby resisting access to the adjustment screws. Additionally, some embodiments may include at least one aperture within the cover, and a corresponding aperture within the motor operator housing, permitting a wire or other objects to be inserted through these pairs of apertures, thereby securing the cover in the closed position.

An adjustment screw cover of the present invention may be utilized with either three-pole circuit breakers, having two adjustment screws, or four-pole circuit breakers, having three adjustment screws. To accommodate both types of circuit breakers, the adjustment screw cover defines three apertures, with two of the apertures being located within the main portion of the cover, and the third aperture being located within a detachable third portion of the cover. If the cover is used with a four-pole breaker, the cover is used as is, with the end section in place. If the cover is used with a three-pole breaker, the end portion of the cover may be broken off, so that the cover contains only the two apertures required, without having excessive length.

BRIEF DESCRIPTION OF THE DRAWINGS

Like reference numbers denote like elements throughout the drawings.

DETAILED DESCRIPTION

Figure 1:
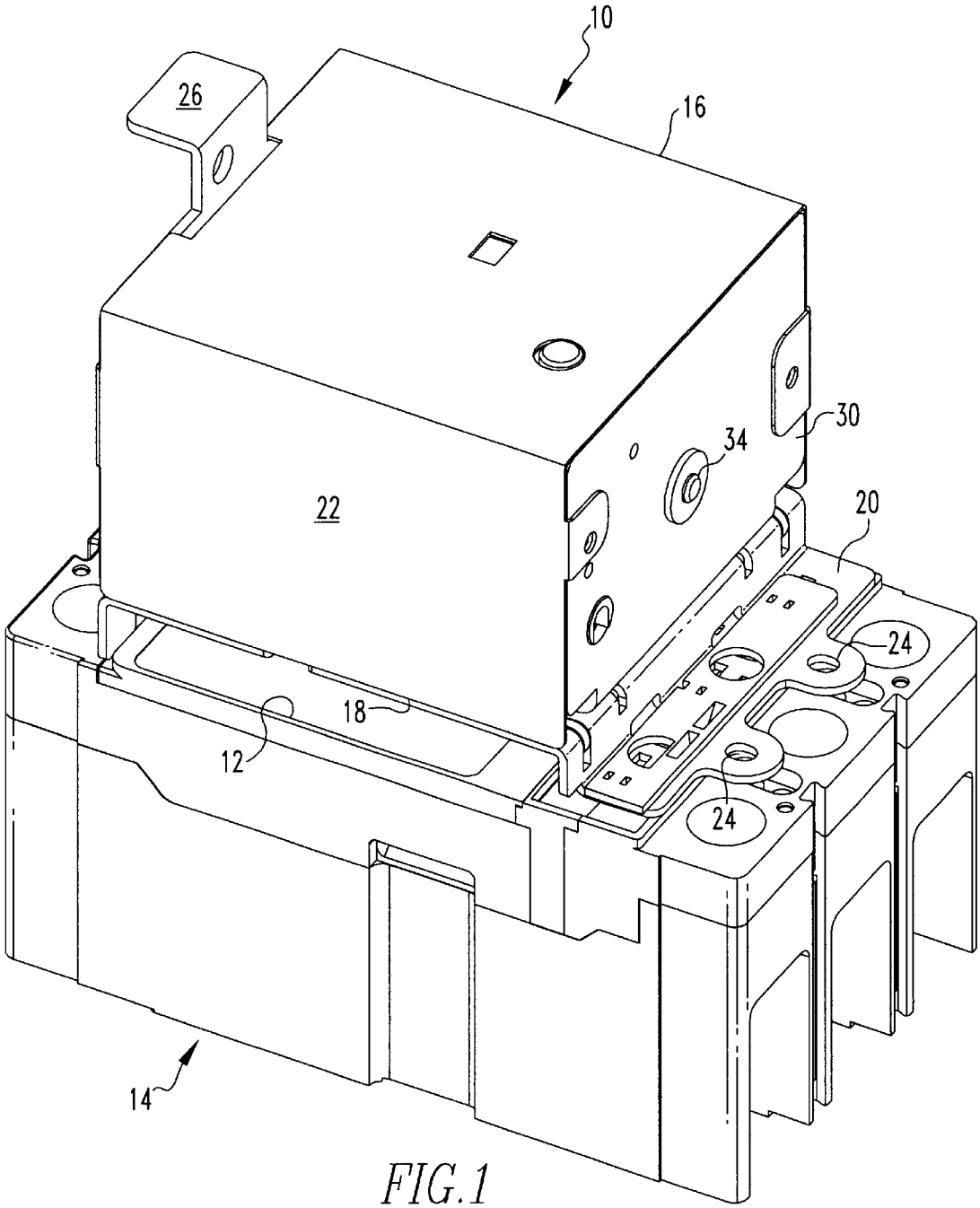
FIG. 1 is a top isometric view of a circuit breaker with its associated motor operator, including an adjustment screw cover according to the present invention.
Figure 2:
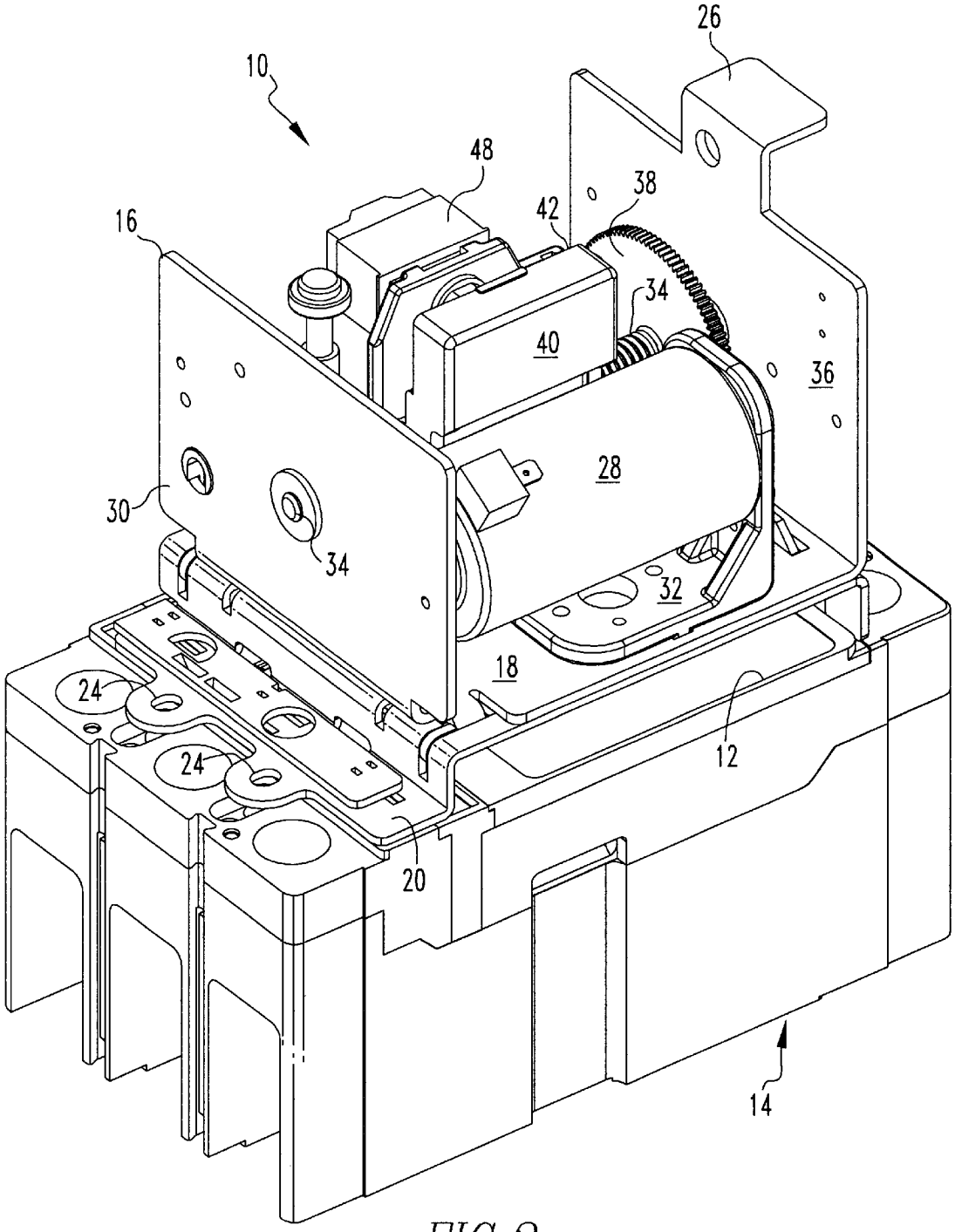
FIG. 2 is an isometric view of a circuit breaker and its associated motor operator, with the cover of the motor operator removed, and including an adjustment screw cover according to the present invention.
Figure 3:
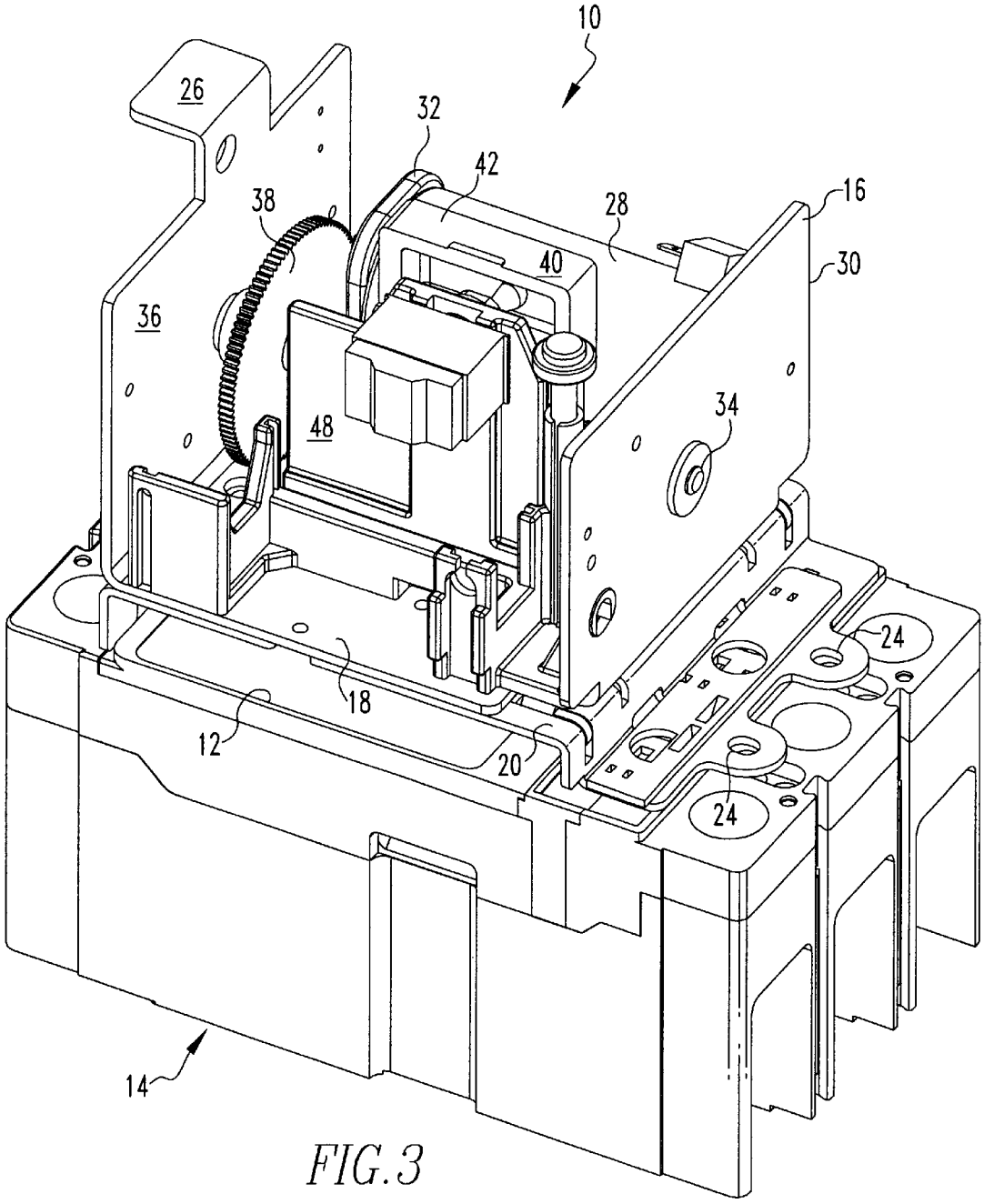
FIG. 3 is an isometric view of a circuit breaker and motor operator, with the cover of the motor operator removed, and including an adjustment screw cover of the present invention.
Figure 4:
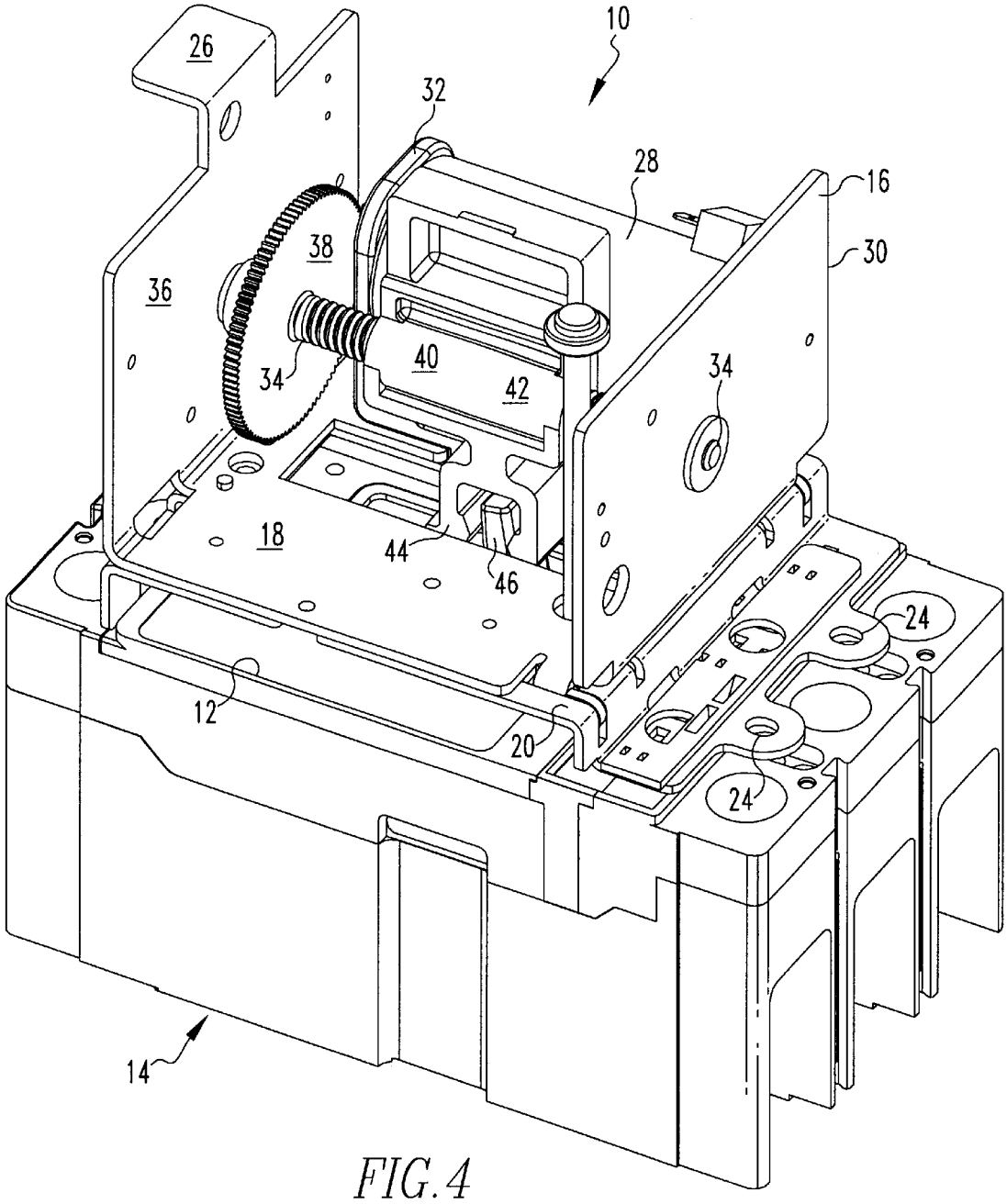
FIG. 4 is an isometric view of a circuit breaker and motor operator, with the cover and printed circuit board of the motor operator removed, and including an adjustment screw cover according to the present invention.
Figure 5:
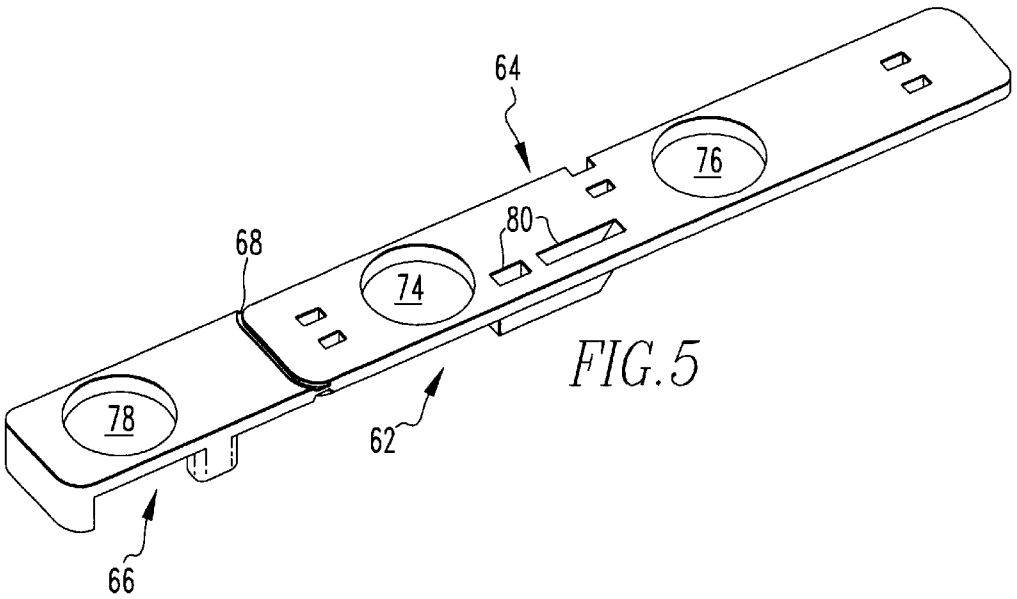
FIG. 5 is a top isometric view of an adjustment screw cover according to the present invention, including the detachable end piece.
Figure 6:
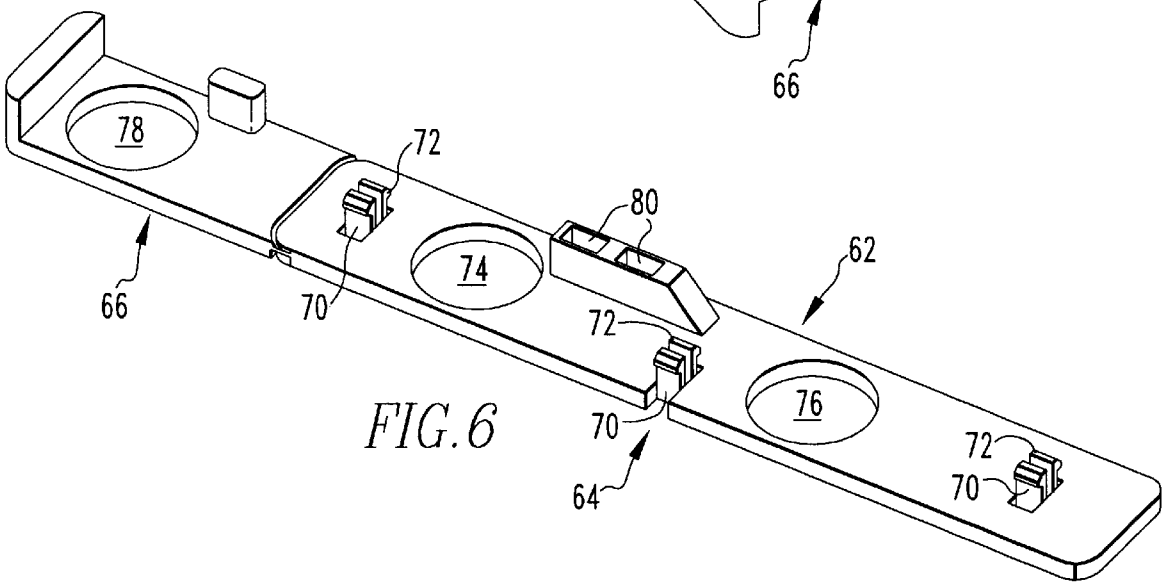
FIG. 6 is a bottom isometric view of an adjustment screw cover according to the present invention, including its detachable end piece.

The present invention provides a cover for the adjustment screws of a circuit breaker, for mounting on the attachment flange of the housing of a motor operator. The invention is best understood through an explanation of the basic operation of a motor operator, and the effect of its installation on access to the circuit breaker's adjustment screws.

FIGS. 1–4 illustrate a motor operator 10 mounted on the face 12 of a circuit breaker 14. The motor operator 10 includes a housing 16 having a base 18, mounting bracket 20, and cover 22. The base 18 is hingedly secured to the mounting bracket 20, which is in turn secured to the face 12 of the circuit breaker 14 by means well known in the art of circuit breakers, for example, screws passing through the apertures 24. The base 18 also includes a lifting tab 26, for lifting the hingedly secured base 18 away from the mounting bracket 20 to provide manual control of the circuit breaker 14. The housing 16 of the motor operator 10 also includes a cover 22, which, in conjunction with the base 18, fully encloses the motor operator 10.

The motor operator 10 includes a motor 28, which in the present example is an electrical motor 28 secured between one wall 30 of the base 18 and the motor bracket 32. A screw shaft 34 extends between the wall 30 and wall 36 of the base 18, being rotatably secured therein at either end. Gear 38 is located at one end of the screw shaft 34, with the gear 38 operatively engaging a corresponding gear that is driven by the motor 28, so that the screw shaft 34 is thereby driven by the motor 28. A sliding actuator 40 includes an upper portion 42 that is threadedly connected to the screw shaft 34, and a lower portion 44 that engages the operating handle 46 of the circuit breaker 14. A kill/toggle switch is located at either end of the range of travel of the sliding actuator 40. The kill/toggle switches, which are not shown but are well known in the art, when actuated by the sliding actuator 40, will simultaneously shut off current to the motor 28, and reverse the direction of current through the motor 28. The flow of current through the motor 28 is further controlled through the printed circuit board 48, and its associated signal processing circuitry (well known in the art).

The motor operator 10 will typically be used to remotely control the operation of the circuit breaker 14, or to control the operation of a large circuit breaker. When the user transmits a signal to close the circuit breaker 14, the control circuitry within the PC board 48 will supply current to the motor 28, thereby rotating the screw shaft 34 to move the sliding actuator 40 from one end of its range of travel to the other, thereby moving the circuit breaker's operating handle 46, and closing the circuit breaker 14. Upon reaching the end of its range of travel wherein the circuit breaker 14 is closed, the sliding actuator 40 hits the kill/toggle switch at that location, thereby shutting off current to the motor 28, and reversing the direction of current to the motor 28. When the user opens the circuit breaker 14, the control circuit within the PC board 48 will again supply current to the motor 28, thereby moving the sliding actuator 40 to the opposite end of its range of travel along the screw shaft 34, moving the circuit breaker's operating handle 46 to the open position. As before, when a sliding actuator 40 reaches the position wherein the circuit breaker is open, it strikes a kill/toggle switch, shutting off current to the motor 28, and also reversing the direction of current flow to the motor 28.

As can be seen from the drawings, the mounting bracket 20 the motor operator 10 covers the adjustment screws, 50, 52 (and possibly 54) of the circuit breaker 14. A typical circuit breaker 14 includes two trip mechanisms, both of which may have adjustable settings. The circuit breaker 14 will trip electromagnetically when a significant amount of overcurrent generates a magnetic force within the breaker sufficient to instantaneously actuate the trip mechanism and open the circuit breaker's main contacts. Additionally, a persistent smaller overload current will heat a bimetallic strip within the circuit breaker 14 causing it to bend until it reaches a point wherein the circuit breaker 14 is tripped. The sensitivity of the magnetic tripping mechanism may be adjusted by the magnetic sensitivity adjustment screw 50, typically the center screw of a four-pole circuit breaker, or the left side screw of three-pole circuit breaker. Likewise, the thermal sensitivity of the circuit breaker 14 may be adjusted using the thermal sensitivity adjustment screw 52, located on the right side of both three-pole and four-pole circuit breakers. A four-pole circuit breaker includes a third adjustment screw 54, on the left side, known as the neutral adjustment screw 54. Adjusting the trip settings of the circuit breaker 14 requires access to these screws. Toward this end, the apertures 56 and 58 are provided within the mounting bracket 20 of the motor operator 10.

Figure 7:
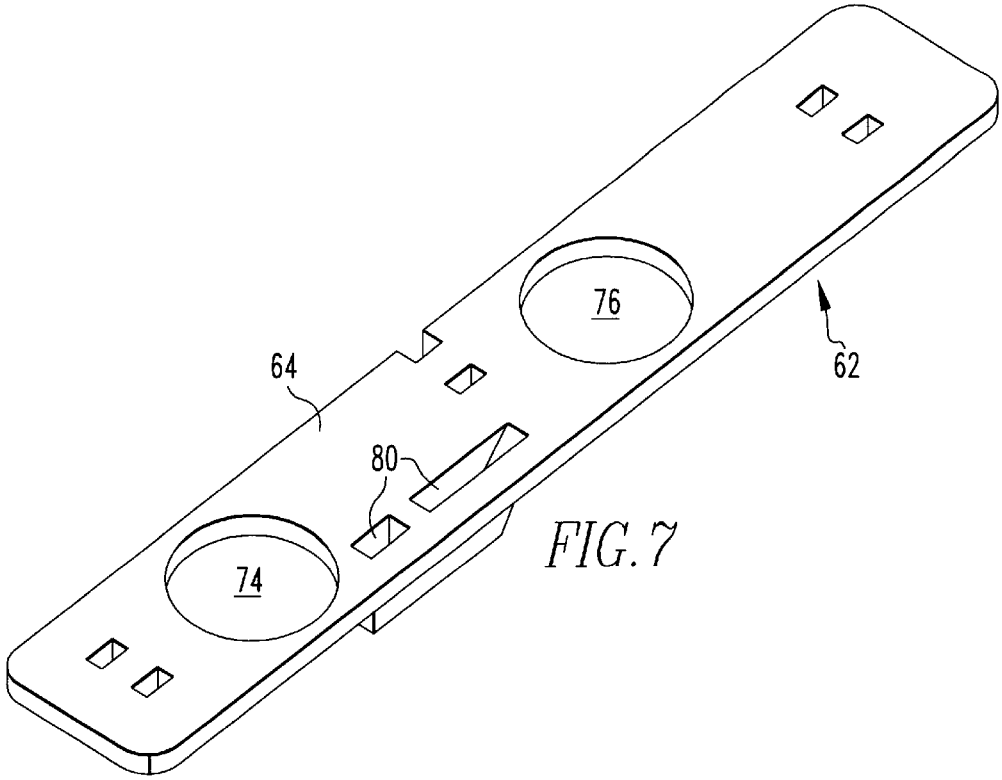
FIG. 7 is a top isometric view of an adjustment screw cover according to the present invention, with its detachable end piece removed.
Figure 8:
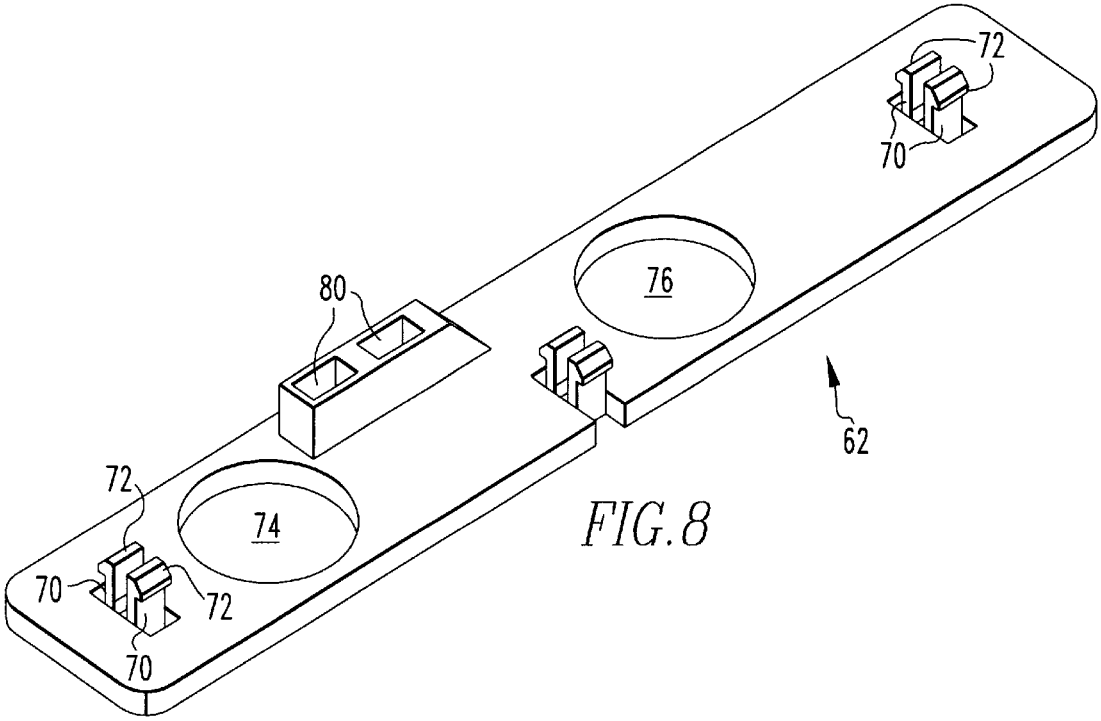
FIG. 8 is a bottom isometric view of an adjustment screw cover according to the present invention, with its detachable end piece removed.

In addition to merely providing access to the adjustment screws 50, 52, 54, it is also desirable to selectively permit or restrict access to the adjustment screws 50, 52, and 54. The present invention incorporates an adjustment screw cover 62 for this purpose. Referring to FIGS. 5–8, an adjustment screw cover 62 is illustrated. The adjustment screw cover 62 includes a body portion 64 and an end portion 66, which may be detached from the body portion 64 as shown in FIGS. 7–8. The body portion 64 and end portion 66 may be separated by a channel 68, thereby facilitating the separation of the end portion 66 from the body portion 64 by simply breaking off the end portion 66.

The body portion 64 of the adjustment screw cover 62 includes at least pair, and preferably a plurality of pairs, of snap-on tabs 70, with each snap-on tab terminating in an outwardly facing hook 72. The body portion 64 further includes an aperture 74, corresponding to the aperture 56 within the mounting bracket 20, and the magnetic sensitivity adjustment screw 50, and an aperture 76, corresponding to the aperture 58 within the mounting bracket 20, and the thermal sensitivity adjustment screw 52. Similarly, the end portion 66 includes an aperture 78, corresponding to the aperture 60 within the mounting bracket 20, and the neutral adjustment screw 54. Some preferred embodiments of the body portion 64 may also include at least one, and more preferably two, slots 80 for receiving a means for securing the adjustment screw cover 62 in one position, as explained below.

Figure 9:
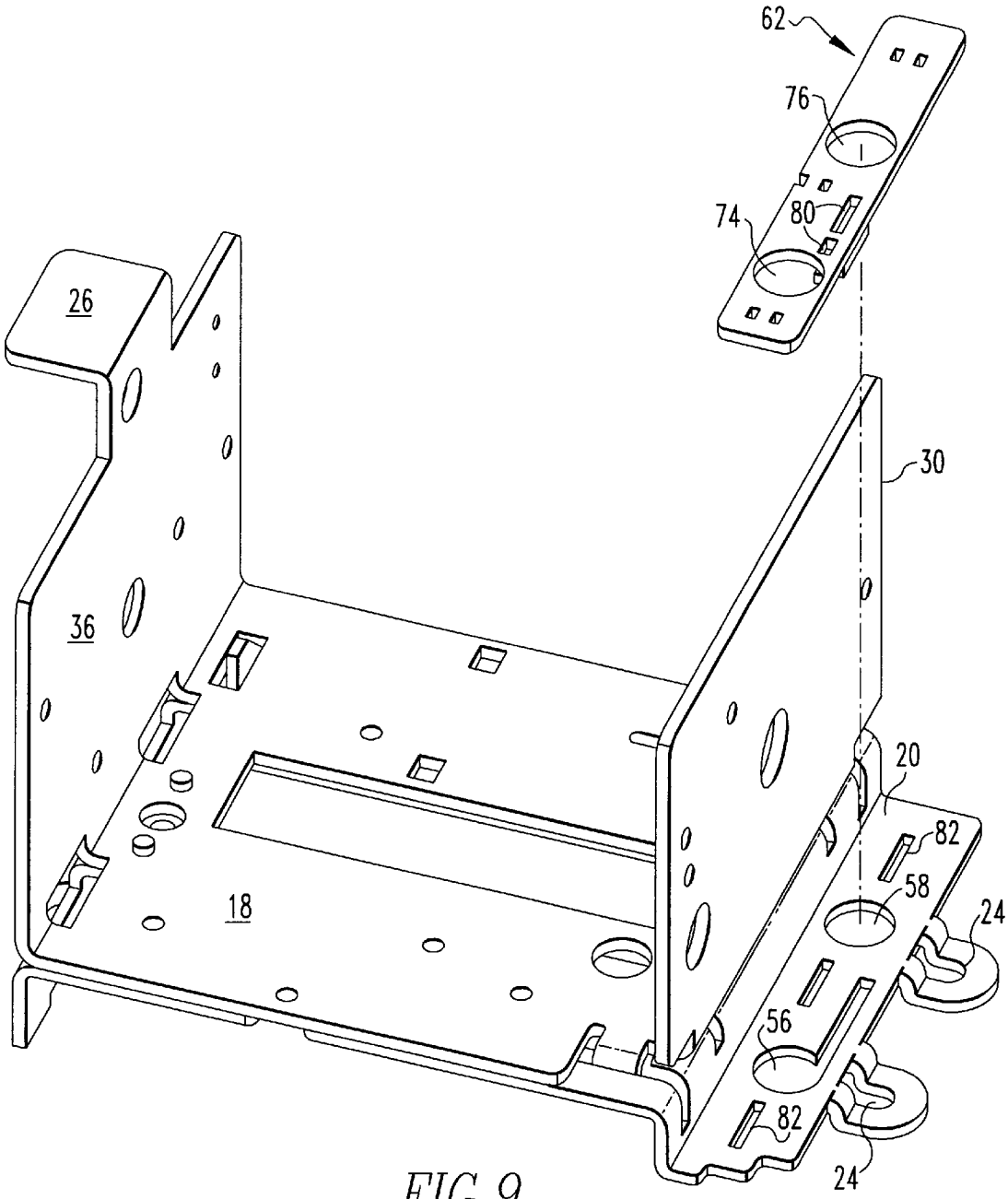
FIG. 9 is a partially exploded isometric view of a housing and adjustment screw cover for a motor operator, according to the present invention.
Figure 10:
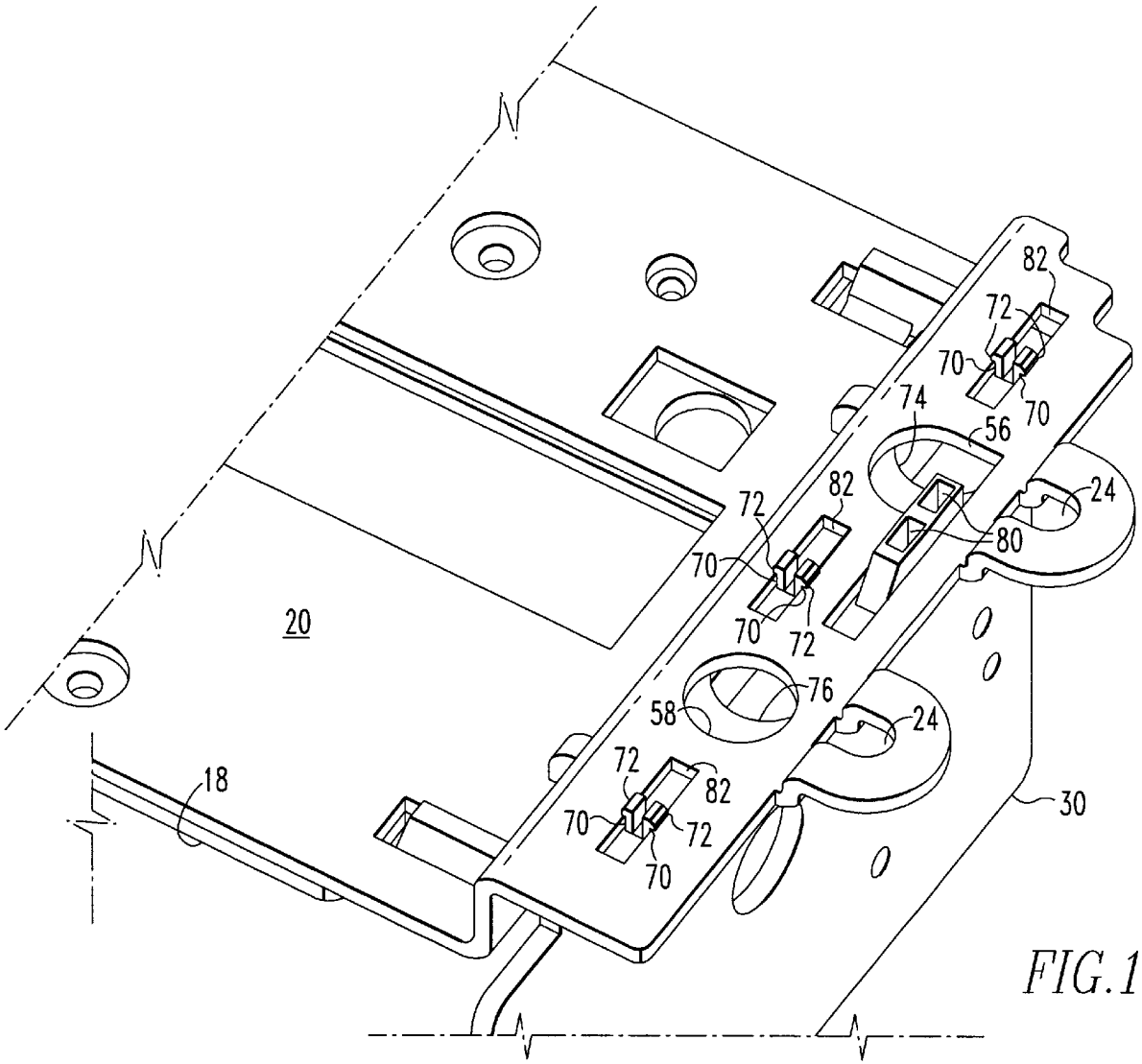
FIG. 10 is a bottom isometric view of a housing for a motor operator, including an adjustment screw cover of the present invention.
Figure 11:
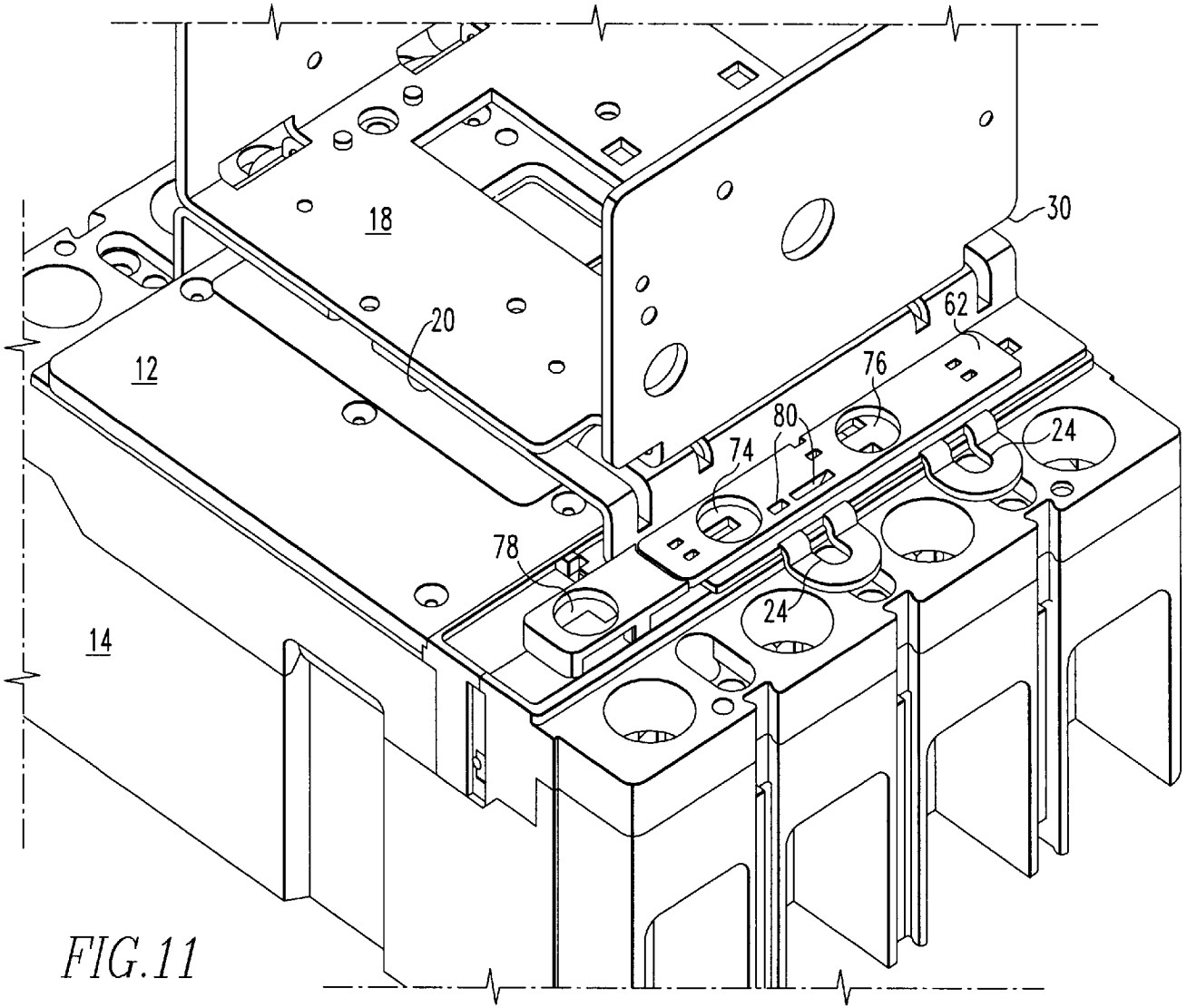
FIG. 11 is a top isometric view of a circuit breaker to which a motor operator housing having an adjustment screw cover of the present invention has been attached.
Figure 12:
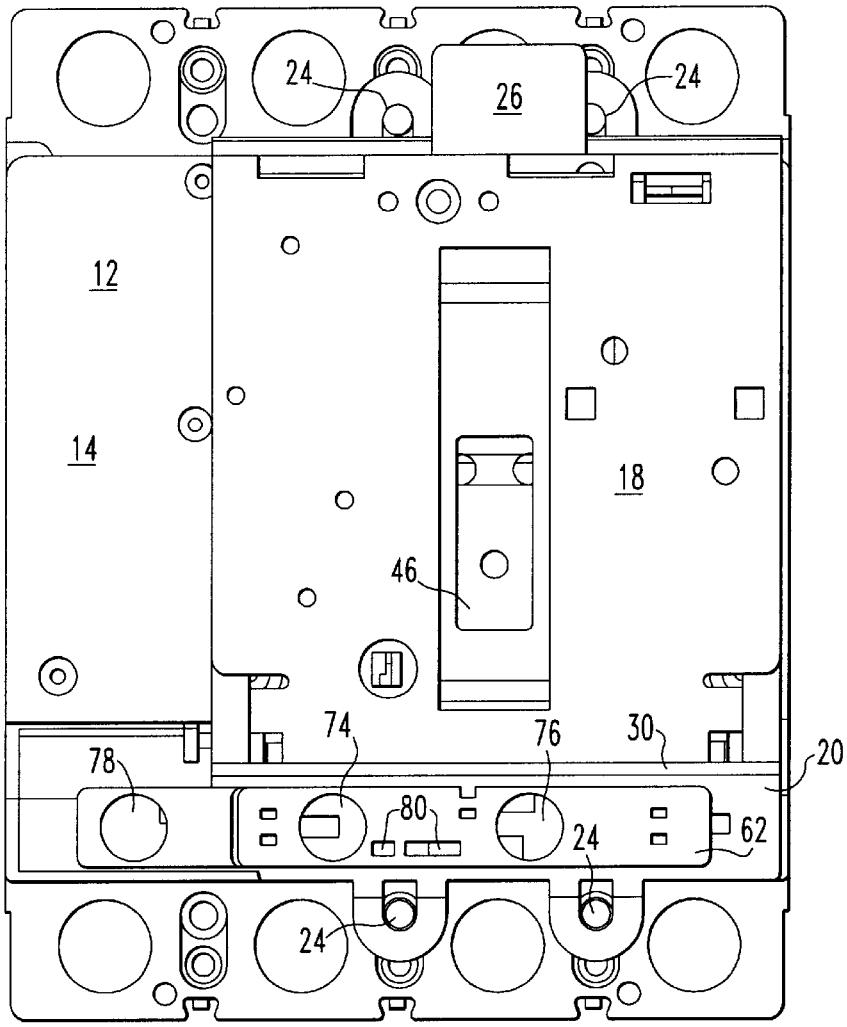
FIG. 12 is a top view of a circuit breaker to which a motor operator housing having an adjustment screw cover of the present invention has been attached, showing the adjustment screw cover in the closed position.
Figure 14:
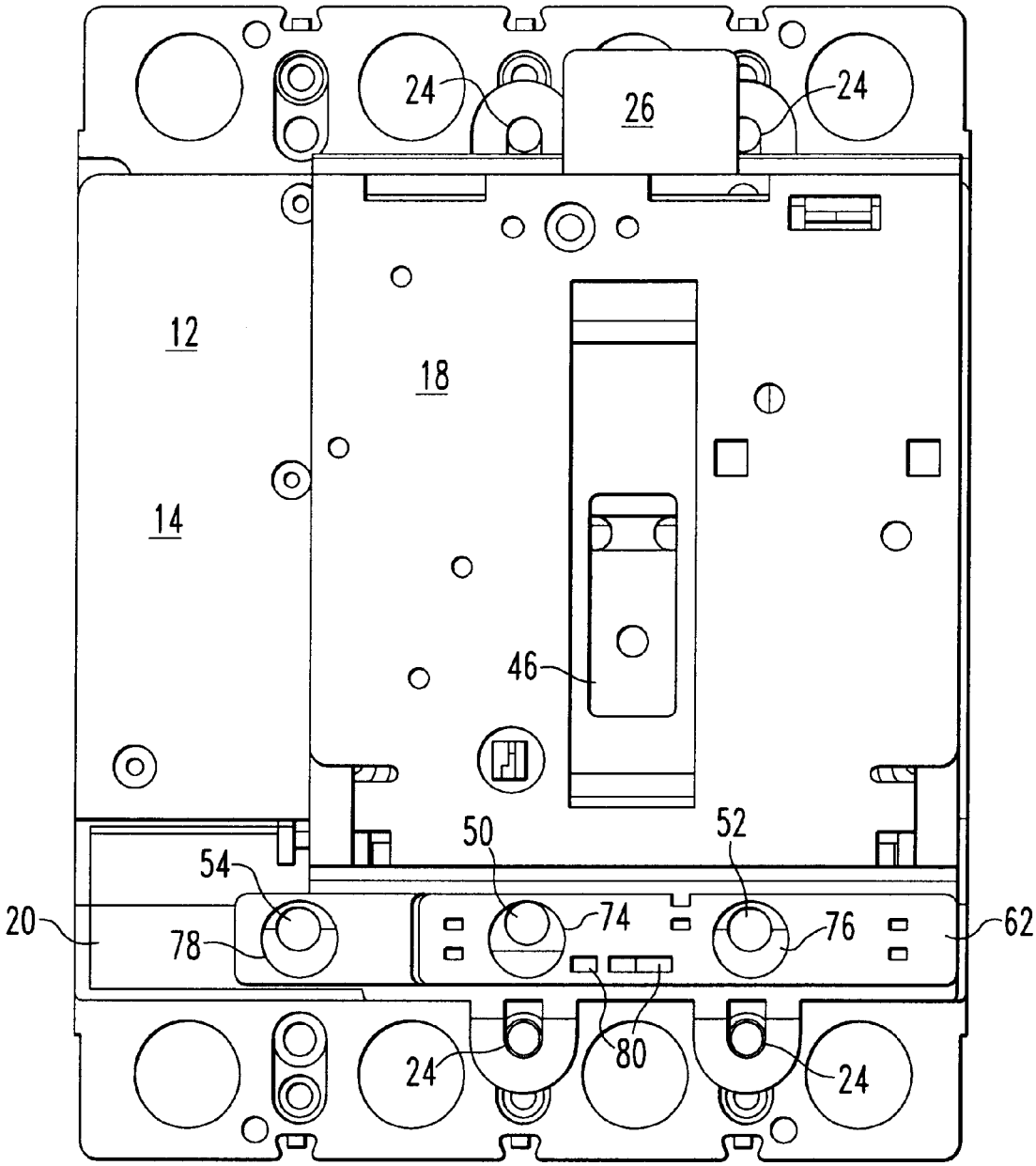
FIG. 14 is a top view of a circuit breaker to which a motor operator housing having an adjustment screw cover of the present invention attached, showing the adjustment screw cover in the open position.

FIGS. 9–11 illustrate the installation of the adjustment screw cover 62 on the mounting bracket 20 of the motor operator 10. The mounting bracket 20 illustrated in FIGS. 9–10 is for a three-pole circuit breaker 14, so the end portion 66 will be broken from the adjustment screw cover 62 before installation. Conversely, the circuit breaker illustrated in FIG. 11 is a four-pole circuit breaker 14, so the end portion 66 will not be broken off of the adjustment screw cover 62. The mounting bracket 20 defines a slot 82 corresponding to each pair of snap-on tabs 70. In the present example, three pairs of snap-on tabs 70, and three slots 82, are present. The adjustment screw cover 62 will be placed on top of the mounting bracket 20 so that the snap-on tabs 70 line up with the slots 82, and then pressed into place. The snap-on tabs 70 will bend inward, permitting the hooks 72 to pass through the slots 82. Once the hooks 72 have completed passed through the slots 82, the snap-on tabs 70 will deflect back to their original position, as shown in FIG. 10, wherein they will secure the adjustment screw cover 62 onto the mounting bracket 20. Referring to FIGS. 12 and 14, the snap-on tabs 70 and slots 82 are dimensioned and configured to permit the adjustment screw cover 62 to slide between a first position wherein the adjustments screws 50, 52 are accessible, through the aligned apertures 74 and 56, and 76 and 58, as illustrated in FIG. 14, and a second position illustrated in FIG. 12, wherein the apertures 74 and 76 are not aligned with the apertures 56, 58, thereby blocking access to the adjustment screws 50 and 52.

Figure 13:
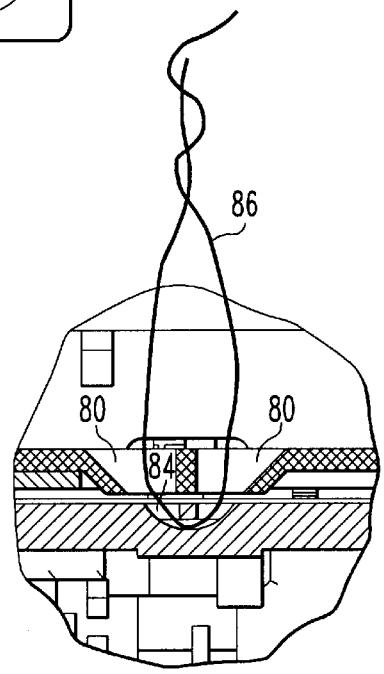
FIG. 13 is a cross-sectional view of a motor operator housing and adjustment screw cover according to the present invention, illustrating a means for securing the cover in its closed position.

Referring to FIGS. 12 and 13, it can be seen that when the adjustment screw cover 62 is in the second position of FIG. 12, the slots 80 within the adjustment screw cover 62 are aligned with the channel 84 within the face 12 of the circuit breaker 14. If it is desired to secure the adjustment screw cover 62 in this position, then a securing means, which in the present example is the twist wire 86, may be passed through the slots 80 and channel 84, thereby securing the adjustment screw cover 62 in the position of FIG. 12.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An adjustment screw cover for use with a motor operator for circuit breakers having adjustment screws, the motor operator comprising a housing, a mounting bracket depending from the housing, the mounting bracket extending over the adjustment screws of the circuit breaker, the mounting bracket defining a hole corresponding to each of the adjustment screws and dimensioned and configured to permit access to the adjustment screws, the mounting bracket further defining at least one slot, the adjustment screw cover comprising:

a body portion and a detachable end portion;

at least one pair of snap-in tabs depending downward from said body portion, said at least one pair of snap-in tabs being dimensioned and configured for snap-in, sliding engagement with at least one corresponding slot defined within said mounting bracket, and to permit said adjustment screw cover to slide between a first position and a second position two apertures defined within said body portion, said apertures being dimensioned and configured to align with two of said holes within said mounting bracket and to permit access to two of the adjustment screws for the circuit breaker only when said adjustment screw cover is within said first position; and an aperture defined within said detachable end portion, said aperture being dimensioned and configured to align with one of said holes within said mounting bracket and to permit access to one of the adjustment screws for the circuit breaker only when said adjustment screw cover is within said first position.

2. The adjustment screw cover according to claim 1, wherein said mounting bracket further defines at least one aperture dimensioned and configured to receive means for securing said adjustment screw cover in said second position; said adjustment screw cover further comprising:

at least one aperture dimensioned and configured to receive means for securing said adjustment screw cover in said second position, and to align with said aperture for said securing means within said mounting bracket when said adjustment screw cover is within said second position.

3. The adjustment screw cover according to claim 2, wherein said means for securing said adjustment screw cover in said second position is a wire.

4. The adjustment screw cover according to claim 1, wherein said end portion of said adjustment screw cover is connected to said body portion by a frangible connection which can be selectively broken to detach said end portion from said body portion.

5. The adjustment screw cover according to claim 4, further comprising at least one channel defined between said body portion and end portion of said adjustment screw cover, said channel being dimensioned and configured to facilitate breaking said end portion from said body portion.

6. A motor operator for a circuit breaker having adjustment screws, the motor operator comprising:

a housing;

a mounting bracket depending from said housing, said mounting bracket being dimensioned and configured to cover the adjustment screws of a circuit breaker, said mounting bracket defining a hole aligned with each of said adjustment screws and dimensioned and configured to permit access to said adjustment screws, said mounting bracket further defining at least one slot;

an adjustment screw cover, comprising:

a body portion and a detachable end portion;

at least one pair of snap-in tabs depending downward from said body portion, said at least one pair of snap-in tabs being dimensioned and configured for snap-in, sliding engagement with said at least one slot defined within said mounting bracket, and to permit said adjustment screw cover to slide between a first position and a second position;

two apertures defined within said body portion, said apertures being dimensioned and configured to align with two of said holes within said mounting bracket and to permit access to two of the adjustment screws for the circuit breaker only when said adjustment screw cover is in said first position; and an aperture defined within said detachable end portion, said aperture being dimensioned and configured to align with one of said holes within said mounting bracket and to dimensioned and configured to permit access to one of the adjustment screw for the circuit breaker only when said adjustment screw cover is within said first position.

7. The motor operator according to claim 6, wherein:

said mounting bracket further defines at least one aperture dimensioned and configured to receive means for securing said adjustment screw cover in said second position; and said adjustment screw cover further defines at least one aperture dimensioned and configured to receive means for securing said adjustment screw cover in said second position, and to align with said aperture for said securing means within said mounting bracket when said adjustment screw cover is within said second position.

8. The motor operator according to claim 7, wherein said means for securing said adjustment screw cover in said second position is a wire.

9. The motor operator according to claim 6, wherein said end portion of said adjustment screw cover is connected to said body portion by a frangible connection which can be selectively broken to detach said end portion from said body portion.

10. The motor operator according to claim 9, further comprising at least one channel defined between said body portion and end portion of said adjustment screw cover, said channel being dimensioned and configured to facilitate breaking said end portion from said body portion.

11. A motor operator for a circuit breaker having adjustment screws, the motor operator comprising:

a housing;

a mounting bracket depending from said housing, said mounting bracket being dimensioned and configured to cover the adjustment screws of a circuit breaker, said mounting bracket defining a hole aligned with each of said adjustment screws and dimensioned and configured to permit access to said adjustment screws, said mounting bracket further defining at least one slot;

an adjustment screw cover, comprising:

a body;

at least one pair of snap-in tabs depending downward from said body portion, said at least one pair of snap-in tabs being dimensioned and configured for snap-in, sliding engagement with said at least one slot defined within said mounting bracket, and to permit said adjustment screw cover to slide between a first position and a second position; and an aperture defined within said body portion dimensioned and configured to align with each of said holes within said mounting bracket and to permit access to the adjustment screws for the circuit breaker only when said adjustment screw cover is in said first position.

12. The motor operator according to claim 7, wherein:

said mounting bracket further defines at least one aperture dimensioned and configured to receive means for securing said adjustment screw cover in said second position; and said adjustment screw cover further defines at least one aperture dimensioned and configured to receive means for securing said adjustment screw cover in said second position, and to align with said aperture for said securing means within said mounting bracket when said adjustment screw cover is within said second position.

13. The motor operator according to claim 12, wherein said means for securing said adjustment screw cover in said second position is a wire.

* * * * *